US005481926A

United States Patent [19]

Manson

[11] Patent Number: 5,481,926

[45] Date of Patent: Jan. 9, 1996

[54] TENSION TESTER OF TENNIS RACQUET STRING

[76] Inventor: Darryl D. Manson, 8725 Burcheu Rd., Gilroy, Calif. 95020

[21] Appl. No.: 353,505

[22] Filed: Dec. 9, 1994

[51] Int. Cl.[6] ..... G01L 5/00

[52] U.S. Cl. ..... 73/862.452; 73/862.43

[58] Field of Search ..... 73/862.391, 862.42, 73/862.43, 862.451, 862.452, 862.472

[56] References Cited

U.S. PATENT DOCUMENTS

| | | | |
|---|---|---|---|
| 1,469,280 | 10/1923 | Stahl | 73/862.472 |
| 2,257,483 | 9/1941 | Roche | 73/862.472 |
| 2,401,876 | 6/1946 | Marker et al. | 73/862.472 |
| 3,177,708 | 4/1965 | Saxl | 73/862.472 |
| 3,720,100 | 3/1973 | Grunbaum | 73/862.451 |
| 3,823,609 | 7/1974 | Miyagawa et al. | 73/862.43 |
| 3,834,225 | 9/1974 | Burchett | 73/144 |
| 4,055,999 | 11/1977 | Coke | 73/145 |
| 4,077,256 | 3/1978 | Hollander | 73/145 |
| 4,103,546 | 8/1978 | Hickey | 73/145 |
| 4,116,045 | 9/1978 | Howe | 73/144 |
| 4,241,616 | 12/1980 | Mastrigt | 73/862.472 |
| 4,590,808 | 5/1986 | Lightfoot | 73/862 |
| 4,607,535 | 8/1986 | Okamuro | 73/862.472 |
| 4,747,314 | 5/1988 | Huang | 73/862 |
| 4,794,805 | 1/1989 | Carney et al. | 73/862.47 |
| 4,846,002 | 7/1989 | Brunner | 73/862.47 |
| 4,876,900 | 10/1989 | Carneu et al. | 73/862.47 |
| 5,048,352 | 9/1991 | Vgarte . | |
| 5,133,217 | 7/1992 | Jordoun | 73/862.47 |

*Primary Examiner*—Richard Chilcot
*Assistant Examiner*—Ronald Biegel
*Attorney, Agent, or Firm*—Robert Samuel Smith

[57] ABSTRACT

A tensiometer for measuring the tension in the individual strings of a tennis racquet featuring a pair of rods which stradle the string to be tested, the rods extending from a base, a lever disk rotably mounted on the base and coupled by a spring to the base so that when the lever disk is rotated, the magnitude of torque required to overcome the tension in the strting and turn the base relative to the lever disk is indicated on a scale. The device also features a construction for adjusting the lever disk relative to the base in order to eiminate effects of the thickness of the string on tension reading.

10 Claims, 3 Drawing Sheets

TENSION TESTER OF TENNIS RACQUET STRING

FIELD OF THE INVENTION

This invention relates to devices for measuring tension in the strings of tennis rackets and particularly to a spring actuated device having probes inserted between strings of the tennis racquet and including a dial readout of tension when a knob is turned.

BACKGROUND AND INFORMATION DISCLOSURE

The condition of a tennis racquet is an important concern for the serious tennis player. One of the important considerations is the tension of the strings which has an important influence on the effectiveness of the players skill. Numerous devices have been disclosed for measuring directly the tension of the racquet strings.

U.S. Pat. No. 3,834,225 to Burchett discloses a pivoting device having an end which clamps around the string and bends a string laid across the two sides of a channel. The tension is read as the force that is required to bend a section of string laid across the edges of a channel.

U.S. Pat. No. 4,055,999 to Cope is for a base and clamping structure intercoupled on opposite sides of the netting and a compressible spring loaded plunger mounted on the base for shifting movement against one face of the netting such as to deflect the netting to compress the plunger. A tension gauge is provided for measuring deflection of the netting.

U.S. Pat. No. 4,077,256 to Hollander disclose a hydraulic means for measuring the pressure required to move an abuttment member through a required distance.

U.S. Pat. No. 4,103,546 discloses a clamp supporting a spring housing telescoping an upper housing for biasing force against the strings with an indicator calibrated to measure the force against the strings vs. displacement.

U.S. Pat. No. 4,116,054 discloses a frame supporting a member movable against the strings and measuring device to measure displacement vs force.

U.S. Pat. No. 4,590,808 disclose a device for determining tension in grids having different size string areas and also for measuring the compressibility of tennis balls.

U.S. Pat. No. 4,747,314 to Huang discloses discloses a combination piston, pressure gauge, and weighing unit for measuring tension of racquet strings, flex of the shaft and weight of the racquet.

U.S. Pat. No. 4,794,805 discloses a spring loaded member that displaces the net vertical to the plane of the net with a dial indicator to measure distance of compression of a spring.

U.S. Pat. No. 4,846,002 to Brunner discloses a device having a member with a racket support surface joined to a cylinder containing a spring in compression by a bolt passing through the netting. Distance sensing electrical contacts in the recess of the member indicate when a reading is to be made.

U.S. Pat. No. 4,876,900 to Carney et al discloses a device adjustable to nettings of a racket having any one of a range of string sizes and spacings by using a set of interchangeable washers. Deflection of a known type of strain gauge is indicated by a crystal reeadout.

U.S. Pat. No. 5,048,352 to Ugarte discloses a tensioner with a pistol grip for applying a deflecting force and measuring string deflection.

U.S. Pat. No. 5,133,217 to Jordan discloses a tensiometer featuring a force applying probe forcing to the string between two supports and measuring the deflection by angular position of an indicator arm.

All of the above tensiometers have at least one disadvantage that is overcome by the present invention.

THE INVENTION

Objects

It is an object to provide a tensiometer for tennis strings that is small and compact compared to the devices of the prior art.

It is an object that the measurements with the device do not depend on the thickness of the string.

It is an object that the device be made with a small number of parts and use of the device does not require separation of the parts as for example devices of the prior art which have one component on one side of the net be joined to another component through the e netting.

It is an object that measurements be made very quickly and simply compared to devices of the prior art.

It is another object that a measurement of tension may be made on any one string independent of the other strings in the racquet.

SUMMARY

This invention is directed toward a tensiometer in which a string is inserted between two parallel rods extending from a base which is coupled by a spring to a lever. The base is turned by a fixed rotational distance relative to the direction of the string by turning the lever through an angle whose value depends on the tension in the string. The angle is indicated on a dial which is rotatably mounted on the base. The "zero" position of the dial relative to the base (before turning the lever) is set at a location indicated on the dial according to the thickness of the string.

DRAWINGS

DESCRIPTION OF THE BEST MODE

Figure 2:
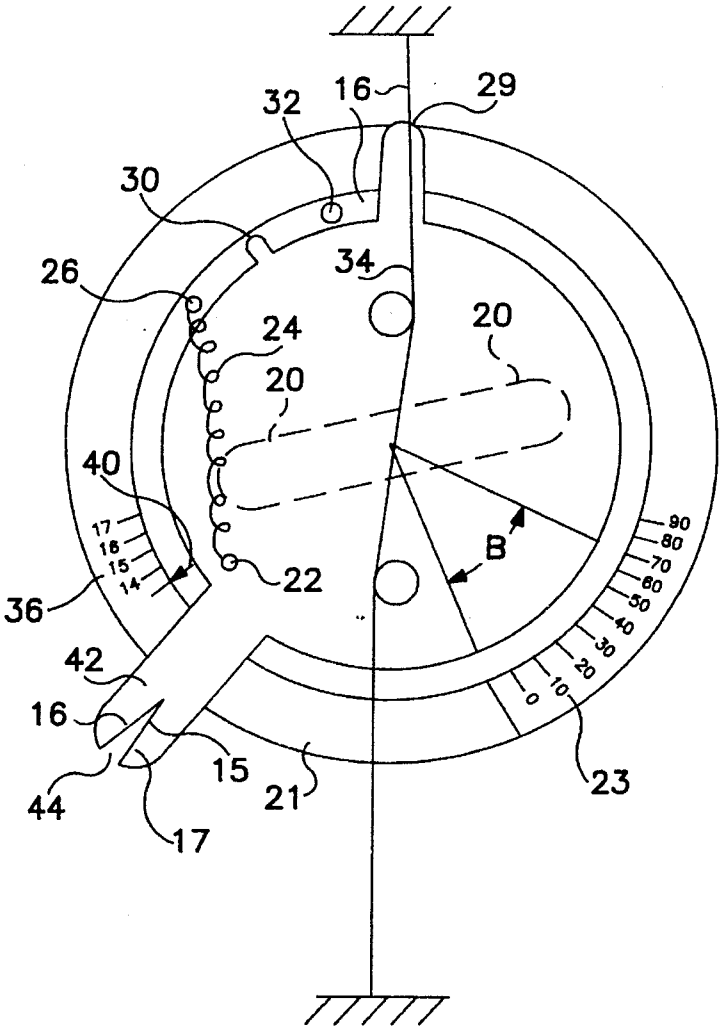
FIG. 2 is a mechanical schematic diagram of the invention presente to clarify an explanation of the principles of the invention for the case of testing a very thin suing after turning the lever handle.
Figure 1:
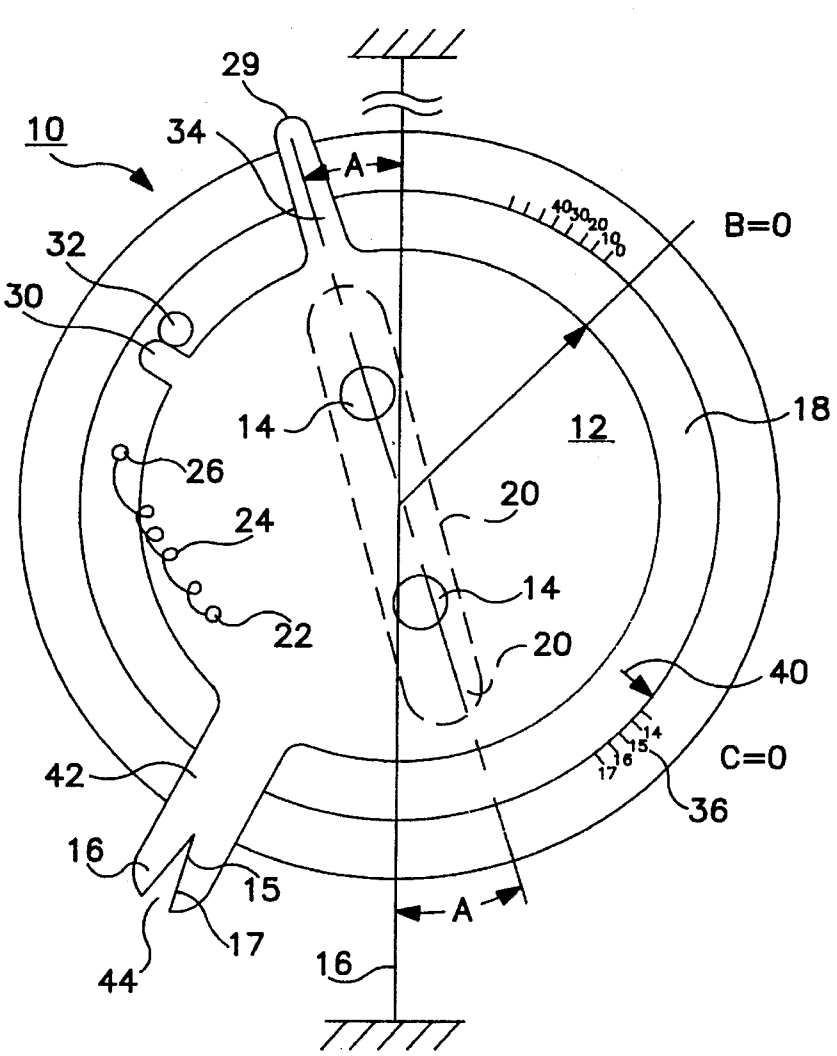
FIG. 1 is a mechanical schematic diagram of the invention presente to clarify an explanation of the principles of the invention for the case of testing a very thin string before turning the lever handle.
Figure 3:
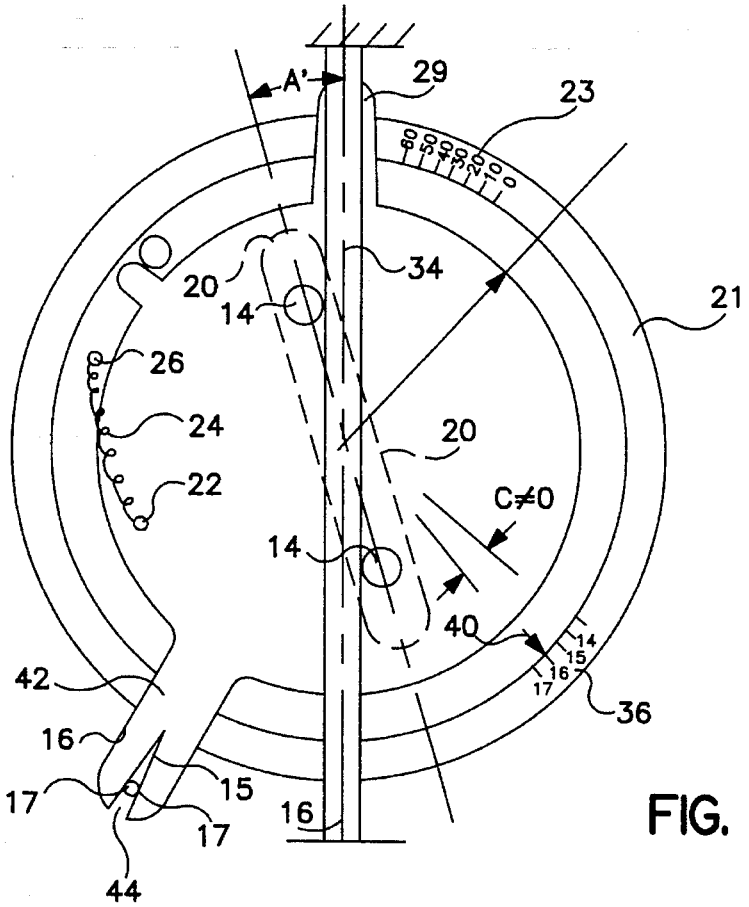
FIG. 3 is a mechanical schematic diagram of the invention presente to clarify an explanation of the principles of the invention for the case of testing a thick string before turning the lever handle.
Figure 4:
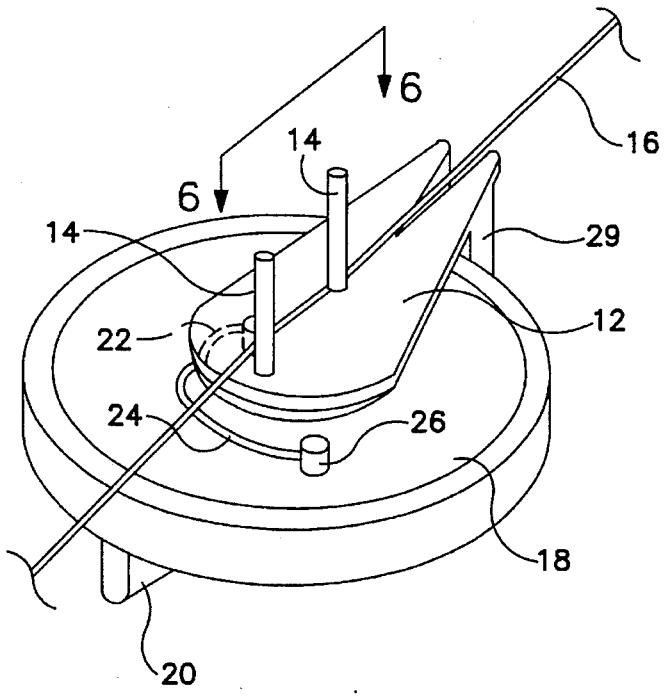
FIG. 4 is a perspective view of a practical construction of the invention.
Figure 6:
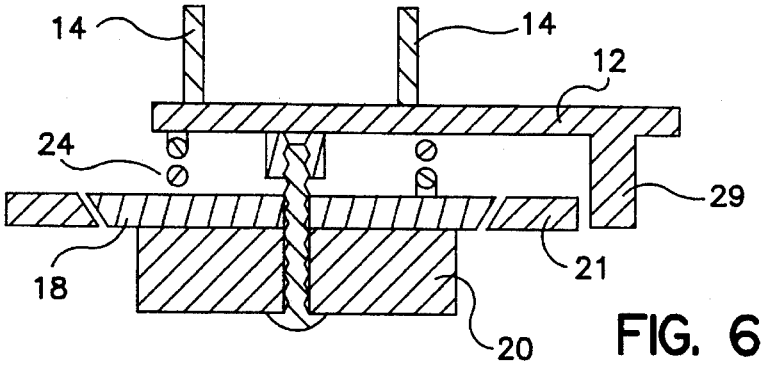
FIG. 6 is a sectional view of FIG. 4.

Turning now to the drawings, FIGS. 1, 2. 3 are simplified drawings illustrating the principles of the invention 10 shown in the perspective views FIG. 3 and 4 and sectional view FIG. 6.. There is shown in FIG. 1 an undetected string 16 positioned between two rods 14 mounted on base 12. A lever disk 18 is rotatably mounted on base 12. A lever handle 20 (shown in phantom in FIG. 1)is integrally formed on the lever disk 18. One end 22 of a spring 24 is attached to base 12 and the other end 26 is attached to lever disk 18. Spring 24 biases lever disk 18 to rotate on base 12 to a "home" position where catch 30 on base 12 is positioned against against stop 32 on lever disk 18. When the lever disk 18 is in the "home" position, (as shown in FIG. 1) the centerline 34 through the rods 14 and marker 29 integral with the edge of the base 12 forms an angle A with the string 16. As shown in FIG. 2, to measure tension, the lever disk 18 is turned using lever handle 20 to angle B where angle A is reduced to substantially zero. The value of angle B, depends on the tension in the string 16, where B is the rotational angle of the lever disk 18 relative to the base 12 resulting from twisting the lever handle 20. Angle B is expressed as tension and displayed by indicia 23. Dial 21 is slidably positioned on and travels with lever disk 18 when lever handle 20 is turned to substantially align centerline 34 with string 16.

As illustrated by comparing the thicknesses of the strings in FIGS. 1 and 3,when the thickness of the string is finite, the "home" position of the lever disk relative to the base is shifted, i.e., angle A is increased to value A' depending on the thickness of the string 16. The dial rim 21 carrying indicia scale 23 indicating angle B is a rim slidably mounted on the edge of lever disk 18. In order to correct for the increase of A to A', a thickness scale 36 is imprinted on the dial rim 21. A thickness marker 40 om lever disk 18 is aligned with the number on the thickness scale 36 which is selected according to the thickness of the string 16 thereby providing that rim scale 36 is adjusted on lever disk 18 such as to compensate for the thickness of the string.

As shown in FIGS. 1–3, the invention also features means 42 for measuring the thickness of the string. There is shown an extension 42 with a V notch 44 with numbers on the side of the notch indicating thickness of the string. The string is positined in the notch as close to the apex as possible and the thickness is read from the side of the notch. For example, FIG. 3 shows a string 17 having size 16 positioned in the notch. This size value is used to shift the lever disk 18 to the "home" position on scale 36 appropriate for the size "16" string prior to proceeding with the measurement of tension. FIGS. 1–3 show the notch located in an "ear" 42 jutting from the base wherein the ear is shaped so that the ear 42 may be inserted between the strings in the grid of the racquet.

Figure 5:
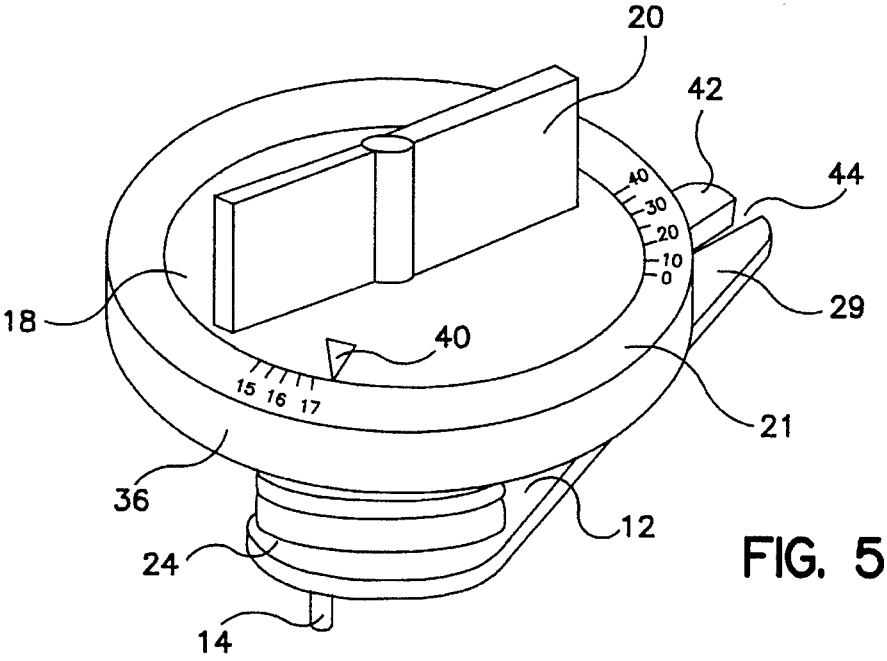
FIG. 5 is another perspective view of the construction of the invention shown in FIG. 4.

FIGS. 4, 5 are perspective views and FIG. 6 is a sectional view of a practical design of the invention shown in FIGS. 1,2 and 3.

The measurement is performed in the following four steps:

1. Set the sliding scale according to the thickness of the string.
2. Position the string to be tested between the rods.
3. Turn the lever handle until the string is aligned with the "home" mark on the base.
4. Read the tension directly from the dial as where the "home" mark on the base is aligned with the tension reading on the dial.

The foregoing discussion presents a description of the invention that meets the objects of the invention. The device is very quick and simple to use in four steps. The number of parts are small. The device measures tension in only one string at a time. The device is applied to only one side of the netting. The readings are calibrated according to the thickness of the string.

Variations and modifications may be suggested to the reader after studying the drawings and specification that are within the scope of the invention.

For example, in place of the two rods, a short upstanding panel may be molded integrally with the base wherein the the panel has a slot into which the string is inserted.

More than one scale may be imprinted on the dial rim so that the user may select any one of the scales for indicating tension. One scale may indicate tension in pounds, another scale may indicate tension in kilograms, and the another scale may indicate tension in pounds superimposed on kilograms.

A different member such as an elastic band for applying restoring force may be substituted in place of the helical spring.

The dial may be a dial disk mounted to rotate concentrically with the lever disk after the rotational position of the dial disk has been positioned to account for the thickness of the string.

A series of inline holes for receiving the rods may be provided in the base in order to relocate the rods and thereby provide a number of ranges for measuring tension.

The notch for gaging thickness may be positioned in the lever disk or any other convenient location.

In general, measuring tension in a string may be equated to measuring resilience in a flexible member such as a bar or sheet. In order to measure resiliency in a flexible bar, the addtional step of first ends of anchoring bar would be performed.

Figure 7:
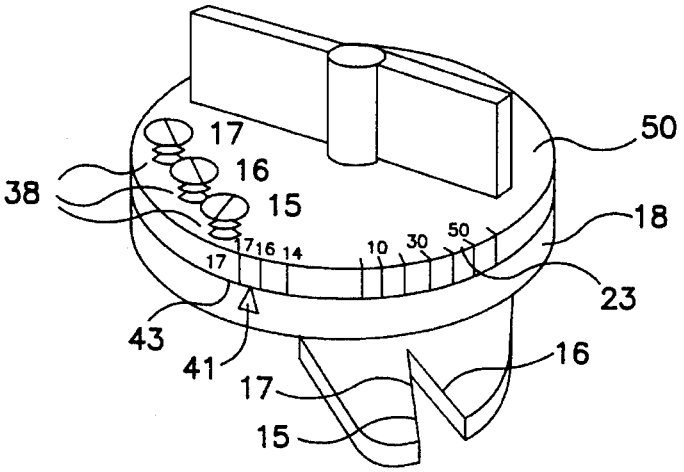
FIG. 7 shows a prqactical construction featuring a dial disk.

As shown in FIG. 7, the tension scale 23 may be on a disk 50 rotatably mounted and adapted for detachably engaging the lever disk 18 by tightening a set screw 38 that engages the dial disk 50 with the lever disk 16 after first aligning pointer 41 on the lever disk 18 to the dial setting 43 on the dial disk 50 corresponding to the thickness of the string to be tested.

The device may be used to measure resiliency of a flexible sheet by inserting the edge of the sheet between the rods by anchoring the sheet on two ends of an edge of the sheet. The reference position to which the base is turned to obtain a tension or restoring force readout need not be the rotational position of alignment o.

In view of these and other variations and modifications, I wish to define the scope of my invention by the appended claims.

I claim:

1. A device for measuring resiliency in an elongated flexible member having a thickness wherein ends of said elongated flexible member are anchored, said device comprising:

a base member having a first surface;

an extending member extending from said first surface and having a space adapted for straddling said elongated member having anchored ends such that an elongated dimension of said flexible elongated member is parallel to said surface;

a lever member rotatably mounted on a second surface of said base member opposite said first surface;

said lever member mounted to rotate about an axis perpendicular to said first surface and intermediate said space in said extending member;

a restoring position means having one end secured to said base member and another end secured to said lever member for biasing said lever member to rotate to a home position relative to said base member;

a dial means for reading orientation of said lever member relative to said base member;

said dial means, base member, extending member, lever member and restoring means arranged in operable combination with one another such that, when said extending member straddles said flexible member with said elongated dimension substantially parallel to said first surface and said lever member is rotated such as to apply torque through said restoring member to said base member and thus through said extending member to bend said flexible member, and when said torque is sufficient to cause alignment of a preset location on said base with a direction of said elongated dimension, said dial displays an angle by which said lever member has been rotated relative to said base member thereby indicating resiliency of said flexible member.

2. The device of claim 1 wherein said device has an edge with a V shaped notch with indicia along an edge of said notch which indicate thickness of said flexible member when said flexible member is inserted in said notch.

3. The device of claim 2 wherein an ear extends from a position located on said base member or said lever member and has a shape adapted for permitting insertion of said ear between strings of said netting.

4. The device of claim 1 wherein a position of said dial means relative to said lever means is positionable to accommodate any thickness of said flexible member in a range of thicknesses such that said angle displayed by said dial is independent of thickness.

5. The device of claim 1 wherein said elongated flexible member is a string in which resiliency is conferred by tension in in said string and said device comprises:

said extending member being a pair of parallel rods perpendicularly mounted on said first surface of said base member and separated from one another by said space;

said lever member is a lever disk substantially parallel to said first and second surfaces of said base member and mounted on said base member to rotate about its center and a lever handle integrally joined with said disk and adapted such that a user can grasp said lever handle and turn said lever disk relative to said base;

said restoring means is a helical spring concentric with said axis of said disk and having one end secured to said disk and another end secured to said base member;

aid base member having a stop and said disk member having a catch and said lever disk is biased by said spring to force said stop toward said catch;

6. The device as in claim 5 wherein said dial means is a row of indicia arranged on an edge of said lever disk such that, when said lever disk is rotated to align said base member with said home position, an index mark on said base is aligned with a member of said array indicting tension in said string.

7. The device as in claim 5 wherein said dial means is a rim slidably mounted on an edge of said lever disk and wherein rotational position of said dial rim is adjustable with respect to said lever disk such as to eliminate variations of said angle indicating tension due to variations in the thickness of said string and wherein said dial rim has a row of indicia arranged along said rim such that, when said lever disk is rotated from home position to align a mark on said base member with said string, said dial rim rotates with said lever disk and an index mark on said base is aligned with a member of said array indicting tension in said string.

8. The device as in claim 5 wherein said dial means is a dial disk rotatably and concentrically mounted on said lever disk and wherein rotational position of said dial disk is adjustable with respect to said lever disk such as to eliminate variations of said angle indicating tension due to variations in the thickness of said string and wherein said dial disk has a row of indicia arranged around a periphery of said dial disk and said dial disk has means for detachably engaging said lever disk such that said dial disk is enabled to be position with respect to said lever disk according to the thickness of the string and then engaged with said lever disk such that when said lever disk is rotated from home position to align a mark on said base member with said string, said dial disk rotates with said lever disk and an index mark on said base member is aligned with a member of said array indicting tension in said string.

9. The device of claim 8 wherein said means for detachably engaging said dial disk with said lever disk is a set screw between said dial disk and said lever disk.

10. The device of claim 1 wherein said elongated flexible member is a sheet of resilient material.

* * * * *